US011659967B2

(12) United States Patent
Meisman

(10) Patent No.: US 11,659,967 B2
(45) Date of Patent: May 30, 2023

(54) POTTY TRAINING TOOL

(71) Applicant: Gary Meisman, Colorado Springs, CO (US)

(72) Inventor: Gary Meisman, Colorado Springs, CO (US)

( * ) Notice: Subject to any disclaimer, the term of this patent is extended or adjusted under 35 U.S.C. 154(b) by 0 days.

(21) Appl. No.: 17/474,659

(22) Filed: Sep. 14, 2021

(65) Prior Publication Data

US 2023/0084858 A1 Mar. 16, 2023

(51) Int. Cl.
*A47K 11/04* (2006.01)

(52) U.S. Cl.
CPC ..... *A47K 11/04* (2013.01)

(58) Field of Classification Search
CPC ..... A47K 11/04; A47K 11/06
USPC ..... 4/483, 92, 902
See application file for complete search history.

(56) References Cited

U.S. PATENT DOCUMENTS 5,363,516 A * 11/1994 Butts ..... A47K 11/06 434/247
5,560,051 A * 10/1996 Butts ..... G09B 19/0076 4/479
5,867,848 A * 2/1999 Ort ..... E03D 13/005 4/661
8,784,110 B2 * 7/2014 Hug ..... A47K 17/00 434/247
2021/0106189 A1 * 4/2021 Green ..... G09B 19/0076

* cited by examiner

*Primary Examiner* — Huyen D Le
(74) *Attorney, Agent, or Firm* — Lyman Moulton, Esq.; Moulton Patents, PLLC

(57) ABSTRACT

The Potty Training Tool introduces a heat-activated, detachable plastic tool containing drawings that appear when urinated on. The plastic tool is placed on the bottom of a potty toilet. The 'magically appearing' drawings will not only motivate the toddler to use the bathroom, but will also create a consistent reward system that has been previously proven to help children learn how to use their training potty. The disclosed potty training tool includes a portable potty comprising an inside bottom catch surface configured for receiving urine and a defecation from a child user. A detachable and removable catch and tool comprise a top surface visible to the child user designed to fit inside the potty and to catch a urine and to reveal a drawing message based on body temperature heat from the urine.

16 Claims, 1 Drawing Sheet

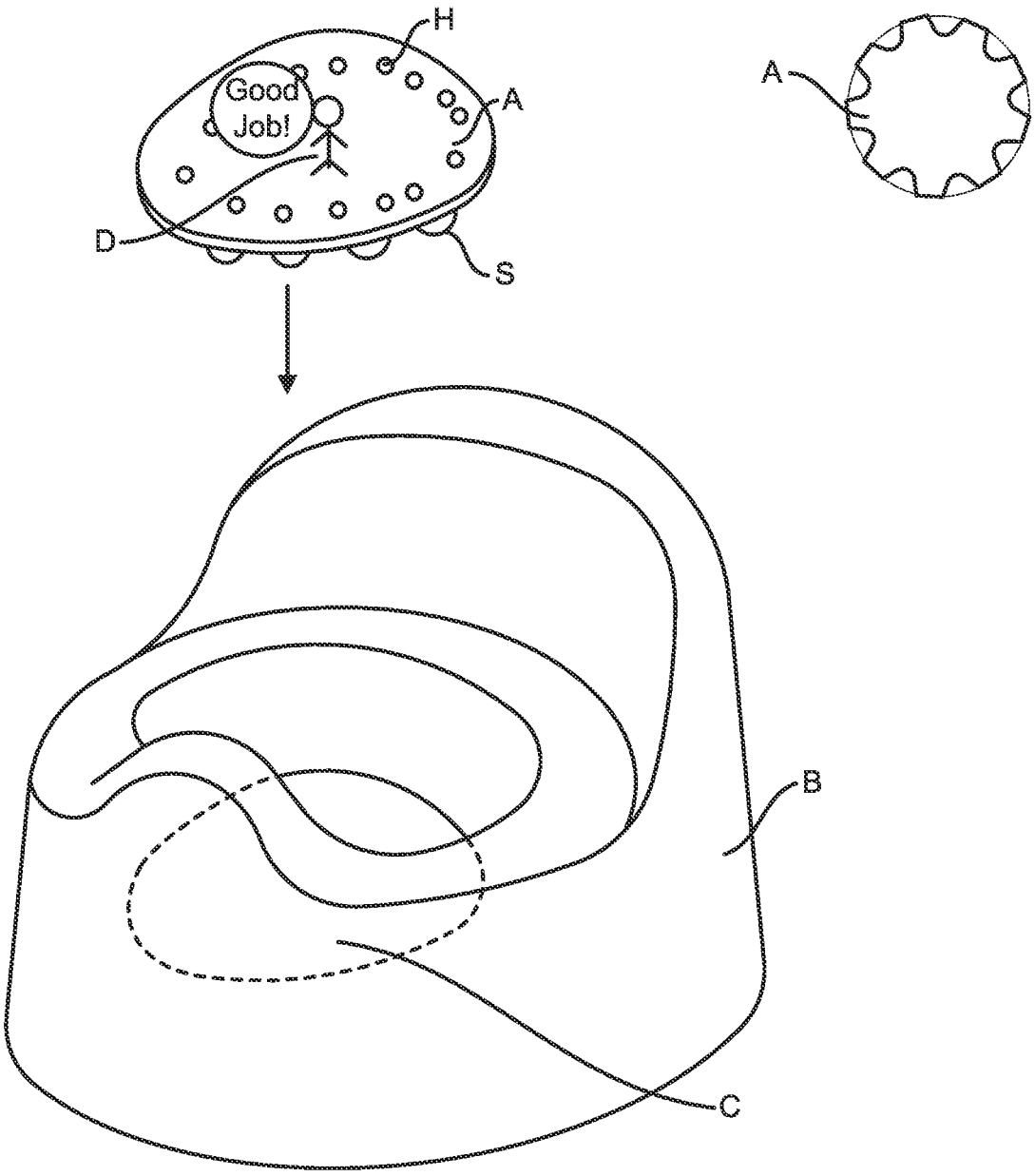
H
Good
Job!
A
D
S
A
B
C

POTTY TRAINING TOOL

BACKGROUND

A potty or potty chair is a proportionately small chair or enclosure with an opening for seating very young children to "go potty." There are a variety of designs, some placed directly over the toilet called "Toilet Training Seats" so the fecal material drops directly into the toilet bowl thereby eliminating manual removal and disposal of the said waste from a receptacle beneath the hole which is often a bag or receptacle similar to a chamber pot. Potty chairs are used during potty training, also called toilet training. Toilet training is the process of training someone, particularly a young child or infant, to use the toilet for urination and defecation.

SUMMARY OF THE INVENTION

The main purpose of the Potty Training Tool is to provide users with a training potty that facilitates training children on releasing themselves via a latrine. As a parent, the time for potty training represents an exciting milestone in a child's life; however, this process is often problematic for most parents, and can be especially tricky when dealing with a temperamental toddler who's stubborn and stuck in his or her own ways. The interest in finding new means to make the potty-training process more enjoyable and entertaining for a child can also present a difficult challenge as the overall activity warrants a great deal of time and patience.

The Potty Training Tool offers a modern alternative that not only encourages toddlers to use the bathroom with confidence, but also transforms the otherwise mundane experience into a more interactive and exciting one. Expanding on the initial design of an average training potty, the Potty Training Tool introduces a heat-activated, detachable plastic tool containing drawings that appear when urinated on. The plastic tool is placed on the bottom of a potty toilet. The 'magically appearing' drawings will not only motivate the toddler to use the bathroom, but will also create a consistent reward system that has been previously proven to help children learn how to use their training potty. The Potty Training Tool ensures a fully operational training device at all times and creates a more inviting appeal to this developmental stage for children to allow for a smoother training experience.

The disclosed potty training tool includes a portable potty comprising an inside bottom catch surface configured for receiving a urine and a defecation from a child user and a removable catch comprising a top surface visible to the child user and configured to fit inside the potty and to catch a urine and to reveal a drawing message based on catching the urine.

BRIEF DESCRIPTION OF THE DRAWINGS

FIG. 1 is a perspective view of the potty training tool in accordance with an embodiment of the present disclosure.

Throughout the description, similar reference numbers may be used to identify similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

FIG. 1 is a perspective view of the potty training tool in accordance with an embodiment of the present disclosure. Reference A depicts the detachable plastic tool with an adhesive backing. When urinated on, the plastic tool will show drawings. Reference B depicts the training potty base. Reference C shows the bottom of the potty where the plastic tool is placed. The view also depicts the drawing and message D, such as a cartoon figure saying, "Good job!" Also, depicted are the drainage holes H and the standoffs S. An alternative view of A includes the perimeter cutouts for a perimeter drainage there around. A perimeter of the detachable and removable catch tool defines a chamfered edge configured to match a slope of the inside bottom catch surface of the portable potty. The detachable and removable catch tool is made from a semiflexible material which conforms to a inside shape of the portable potty toilet bowl or also known as a catch surface.

Herein the potty pad itself is claimed wherein it can be cut to fit various potty chairs including small medium or large or jumbo or custom potty chairs. The respective claims to the potty pad itself are not to be limiting to the claims also including the potty chair but provide the broadest legal scope for the disclosure. The applicant also reserves amendments to include improvement patents including the potty pad itself and accessories thereto.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

While the forgoing examples are illustrative of the principles of the present disclosure in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the disclosure be limited, except as by the specification and claims set forth herein.

What is claimed is:

1. A potty training tool for a toilet and comprising:

a detachable catch tool comprising a top surface visible to a child user and configured to fit inside the toilet and to catch a urine and to reveal a drawing message based on contact with a body temperature heat in the urine, wherein the detachable catch tool comprises standoffs configured to allow the urine and a fluid to drain from the top surface into the toilet.

2. The potty training tool of claim 1, further comprising a plurality of interchangeable detachable catch tools, each having a unique drawing message for the child user.

3. The potty training tool of claim 1, wherein the detachable catch tool defines drainage holes therein for a urine and a fluid to pass there through.

4. The potty training tool of claim 1, wherein a shape of the detachable catch tool is flat with a perimeter edge resembling a tear drop like shape.

5. The potty training tool of claim 1, wherein a shape of the detachable catch tool is flat with a perimeter edge resembling an oval like shape.

6. The potty training tool of claim 1, wherein a shape of the detachable catch tool is flat with a perimeter edge resembling a circular shape.

7. The potty training tool of claim 1, wherein the drawing message is a cartoon figure with a bubble caption saying, "good job!".

8. The potty training tool of claim 1, wherein the drawing message is a cartoon figure with a bubble caption saying, "good job [first name]!".

9. A potty training tool comprising:

a portable potty comprising an inside bottom catch surface configured for receiving a urine and a defecation from a child user; and a removable catch comprising a top surface visible to the child user and configured to fit inside the portable potty inside bottom catch surface and to catch a urine and to reveal a drawing message based on catching a body temperature heat in the urine, wherein the removable catch comprises standoffs configured to allow a urine and a fluid to drain from the top surface thereof into the portable potty.

10. The potty training tool of claim 9, further comprising a plurality of interchangeable catches, each having a unique drawing message for the child user.

11. The potty training tool of claim 9, wherein the removable catch defines drainage holes therein for a urine and a fluid to pass there through.

12. The potty training tool of claim 9, wherein a shape of the removable catch is flat with a perimeter edge resembling a tear drop like shape.

13. The potty training tool of claim 9, wherein a shape of the removable catch is flat with a perimeter edge resembling an oval like shape.

14. The potty training tool of claim 9, wherein a shape of the removable catch is flat with a perimeter edge resembling a circular shape.

15. The potty training tool of claim 9, wherein the drawing message is a cartoon figure with a bubble caption saying, "good job!".

16. The potty training tool of claim 9, wherein the drawing message is a cartoon figure with a bubble caption saying, "good job [first name]!".

* * * * *